US012041966B2

(12) United States Patent
Scatterday

(10) Patent No.: US 12,041,966 B2
(45) Date of Patent: Jul. 23, 2024

(54) MONOLITHIC ELECTRONIC VAPORIZER

(71) Applicant: Jupiter Research LLC, Phoenix, AZ (US)

(72) Inventor: Mark Scatterday, Scottsdale, AZ (US)

(73) Assignee: Jupiter Research, LLC, Phoenix, AZ (US)

( * ) Notice: Subject to any disclaimer, the term of this patent is extended or adjusted under 35 U.S.C. 154(b) by 471 days.

(21) Appl. No.: 17/375,952

(22) Filed: Jul. 14, 2021

(65) Prior Publication Data

US 2022/0039467 A1 Feb. 10, 2022

Related U.S. Application Data

(63) Continuation-in-part of application No. 29/745,661, filed on Aug. 7, 2020, now Pat. No. Des. 948,783.

(51) Int. Cl.
*A24F 40/42* (2020.01)
*A24F 7/02* (2006.01)
(Continued)

(52) U.S. Cl.
CPC ..... *A24F 40/42* (2020.01); *A24F 7/02* (2013.01); *A24F 40/10* (2020.01); *A24F 40/485* (2020.01);
(Continued)

(58) Field of Classification Search
CPC ..... A24F 40/00; A24F 40/40; A24F 40/42; A24F 40/70; A24F 40/53; A24F 40/485;
(Continued)

(56) References Cited

U.S. PATENT DOCUMENTS

D776,338 S 1/2017 Lomeli
D799,110 S 10/2017 Qiu
(Continued)

FOREIGN PATENT DOCUMENTS

CN 203952436 11/2014
CN 113142673 7/2021
(Continued)

OTHER PUBLICATIONS

Vapordna, Disposable Vaporizer, https://vapordna.com/products/halo-vice-disposable-vaporizer, Mar. 16, 2019, accessed on Aug. 14, 2021.

(Continued)

*Primary Examiner* — Khiem M Nguyen
(74) *Attorney, Agent, or Firm* — Schmeiser, Olsen & Watts LLP

(57) ABSTRACT

A monolithic electronic vaporizer is provided. The monolithic electronic vaporizer may include a single molded body. The single molded body may include a fluid reservoir within and formed as part of the single molded body, a top recess located above the reservoir, and a bottom recess located below the reservoir. The monolithic electronic vaporizer may further include a mouthpiece coupled within the top recess after the reservoir is filled with vape fluid. The atomizer with the heater and the wick, the airway, and the mouthpiece of the vaporizer are coupled within the top recess of the single molded body. The remaining components of the monolithic electronic vaporizer may be assembled and coupled within the bottom recess of the single molded body. The monolithic electronic vaporizer may be disposable, and the single molded body may be formed of a recyclable material or a material that can be sterilized and reused.

20 Claims, 10 Drawing Sheets

(51) Int. Cl.

| | |
|---|---|
| ***A24F 40/10*** | (2020.01) |
| ***A24F 40/485*** | (2020.01) |
| ***A24F 40/53*** | (2020.01) |
| ***A24F 40/60*** | (2020.01) |
| ***A24F 40/70*** | (2020.01) |

(52) U.S. Cl.
CPC ..... *A24F 40/53* (2020.01); *A24F 40/60* (2020.01); *A24F 40/70* (2020.01)

(58) Field of Classification Search
CPC .. A24F 40/10; A24F 40/60; A24F 7/00; A24F 7/02
USPC ..... 131/328
See application file for complete search history.

(56) References Cited

U.S. PATENT DOCUMENTS

| | | | |
|---|---|---|---|
| D870,372 | S | 12/2019 | Zhu |
| D885,655 | S | 5/2020 | Ding |
| D898,278 | S | 10/2020 | Carlberg et al. |
| D898,991 | S | 10/2020 | Pan |
| D903,938 | S | 12/2020 | Chimbuya et al. |
| D904,681 | S | 12/2020 | Kim et al. |
| D905,901 | S | 12/2020 | Kim et al. |
| D908,952 | S | 1/2021 | Guo |
| D913,583 | S | 3/2021 | Leo et al. |
| D919,881 | S | 5/2021 | Carlberg et al. |
| D921,979 | S | 6/2021 | Kim |
| 2013/0160764 | A1 | 6/2013 | Liu |
| 2015/0181941 | A1 | 7/2015 | Liu |
| 2016/0073691 | A1 | 3/2016 | Liu |
| 2018/0160737 | A1 | 6/2018 | Verleur et al. |

FOREIGN PATENT DOCUMENTS

| | | |
|---|---|---|
| EP | 2754359 | 7/2014 |
| EP | 2918181 | 9/2015 |
| WO | 2013089551 | 6/2013 |
| WO | 2015117062 | 8/2015 |
| WO | 2018191884 | 10/2018 |
| WO | 2020252076 | 12/2020 |

OTHER PUBLICATIONS

Scatterday et al., Monolithic Electronic Vaporizer, Canadian patent application serial No. 3,129,800, filed Sep. 23, 2021, Office Action dated Dec. 13, 2022.

Scatterday et al., Monolithic Electronic Vaporizer, European patent application serial No. 22184338.6, filed Jul. 12, 2022, Extended European Search Report dated Dec. 13, 2022.

MONOLITHIC ELECTRONIC VAPORIZER

CROSS REFERENCE TO RELATED APPLICATION[S]

This application is a continuation-in-part of the earlier U.S. Utility patent Ser. No. 29/745,661, filed Aug. 7, 2020, the disclosure of which is hereby incorporated entirely herein by reference.

BACKGROUND OF THE INVENTION

Technical Field

This invention relates generally to a vaping device and more particularly to a monolithic electronic vaporizer.

State of the Art

The use of inhalable substances is popular, both for recreational purposes and for medical purposes. One form of using inhalable substances is through smoking. Those that use, particularly those that are using for medical purposes, may like the form of smoking the inhalable substance, but dislike what it visually displays to others around them or the smell that may be associated with smoking the substance. Smoking is also not a convenient form of medicating or dispensing most medicinal substances. Vaping is an option. There are reusable vaping devices and disposable vaping devices. Vaping devices are commonly referred to as vaporizers, and conventional disposable vaporizers are lacking in their sustainability and the effect on the environment.

Accordingly, there is a need for an improved disposable vaporizer that is more sustainable than existing disposable vaping devices.

SUMMARY OF THE INVENTION

An embodiment includes a monolithic electronic vaporizer comprising: a single molded body comprising: a fluid reservoir within the single molded body; a top recess located above the reservoir; and a bottom recess located below the reservoir; and a mouthpiece coupled within the top recess after the reservoir is filled with vape fluid.

Another embodiment includes a method of assembling a monolithic electronic vaporizer, the method comprising: assembling an atomizer with a heater and a wick, and an airway of a vaporizer within a top recess of a single molded body and assembling all remaining components of the vaporizer within a bottom recess of a single molded body; filling a reservoir with vape fluid, the reservoir formed as part of and within the single molded body; and coupling the mouthpiece within a top recess of the single molded body after the reservoir is filled with vape fluid.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a monolithic electronic vaporizer.

Figure 1A:
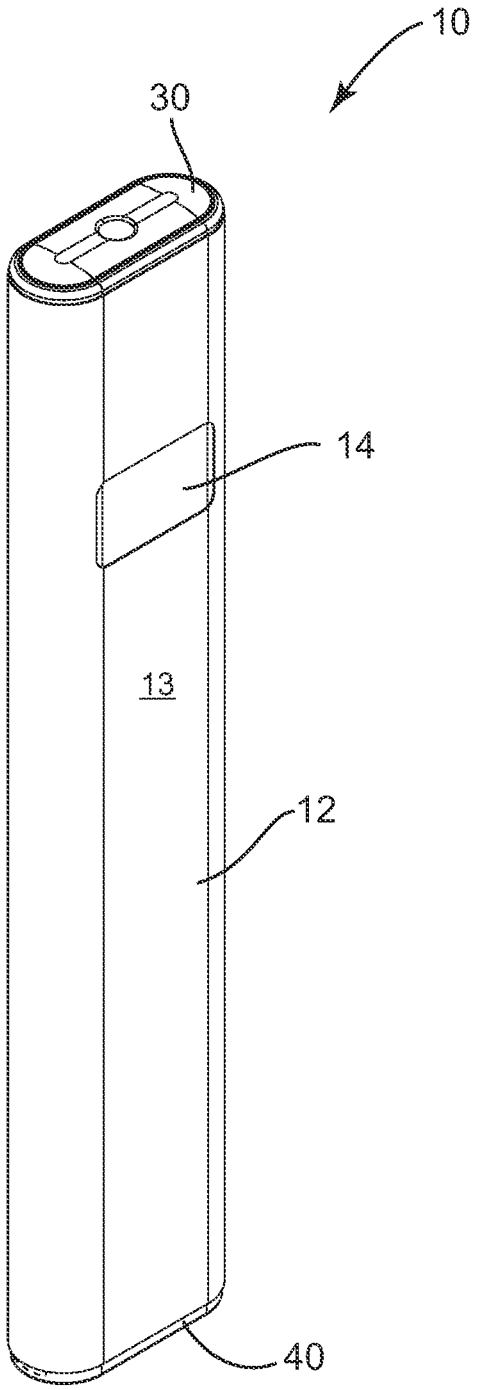
FIG. 1A is a perspective view of a monolithic electronic vaporizer, according to an embodiment.
Figure 1B:
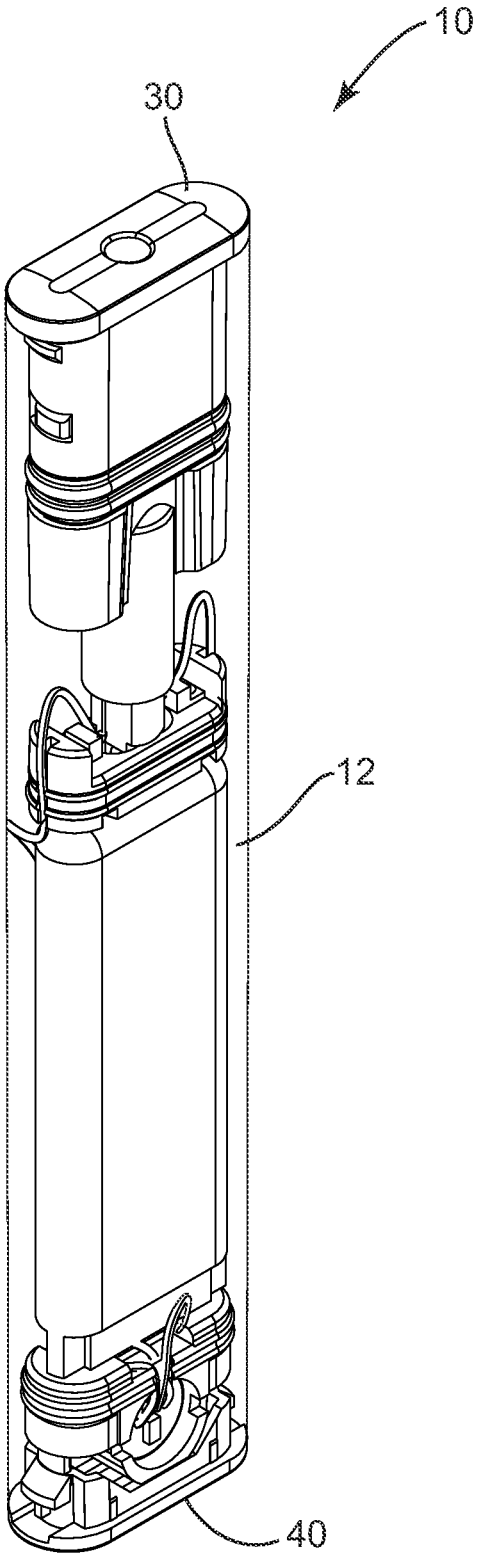
FIG. 1B is a perspective view of a monolithic electronic vaporizer, according to an embodiment.
Figure 2:
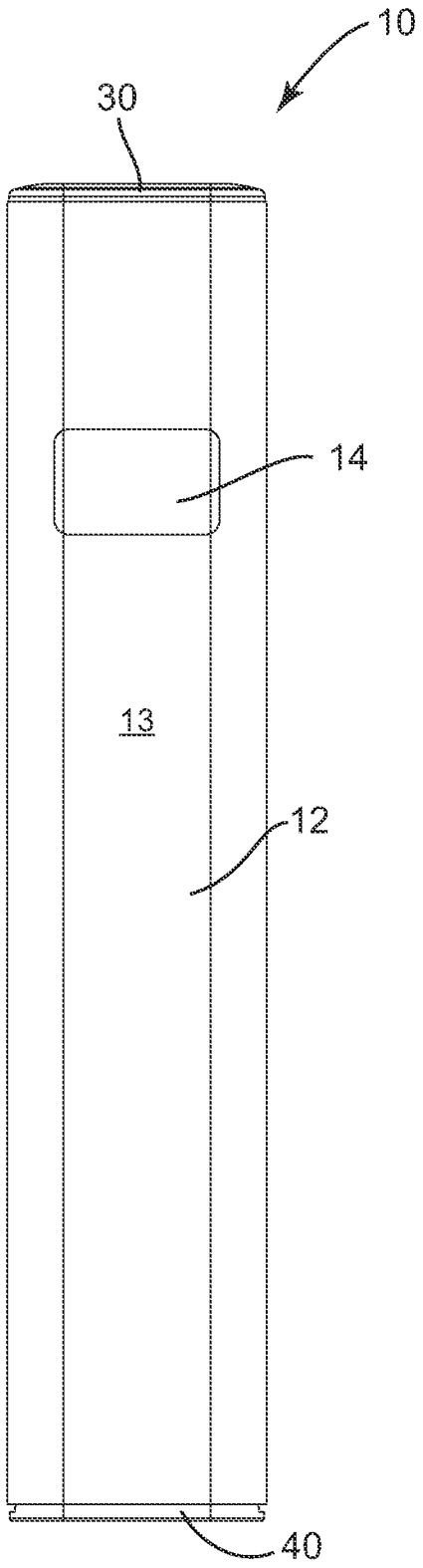
FIG. 2 is a front elevational view of the monolithic electronic vaporizer, according to an embodiment.
Figure 3:
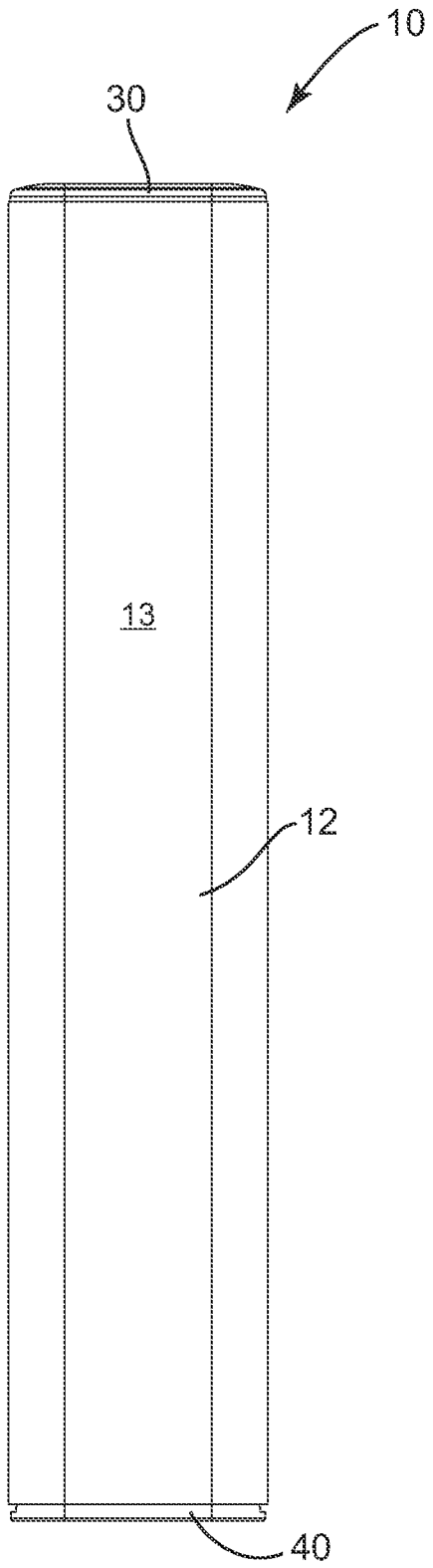
FIG. 3 is a rear elevational view of the monolithic electronic vaporizer, according to an embodiment.
Figure 4:
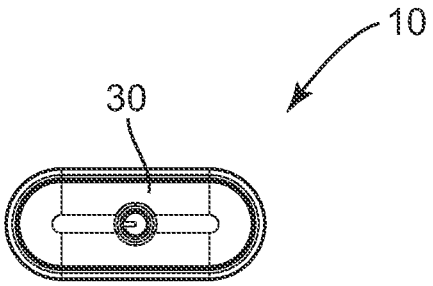
FIG. 4 is a top plan view of the monolithic electronic vaporizer, according to an embodiment.
Figure 5:
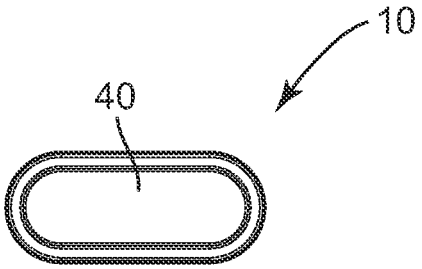
FIG. 5 is a bottom plan view of the monolithic electronic vaporizer, according to an embodiment.
Figure 6:
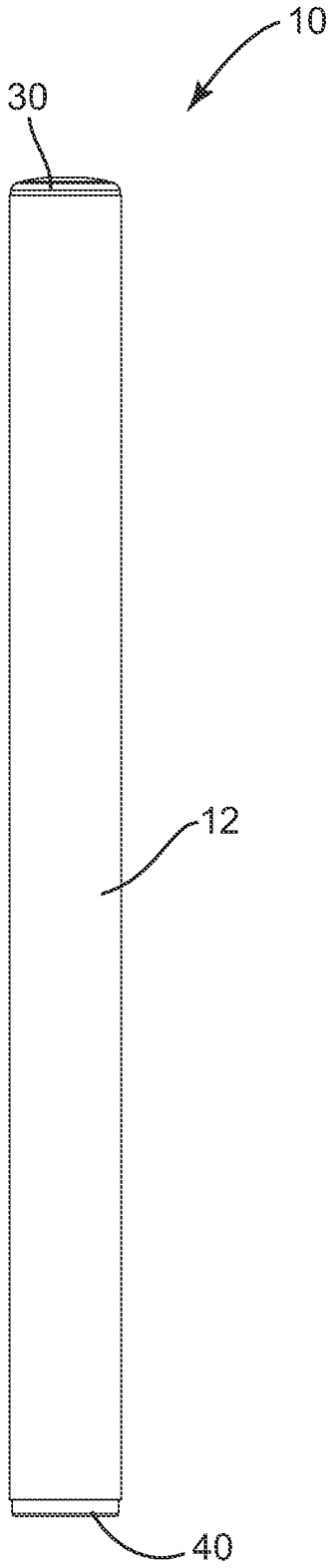
FIG. 6 is a right-side elevational view of the monolithic electronic vaporizer, according to an embodiment.
Figure 7:
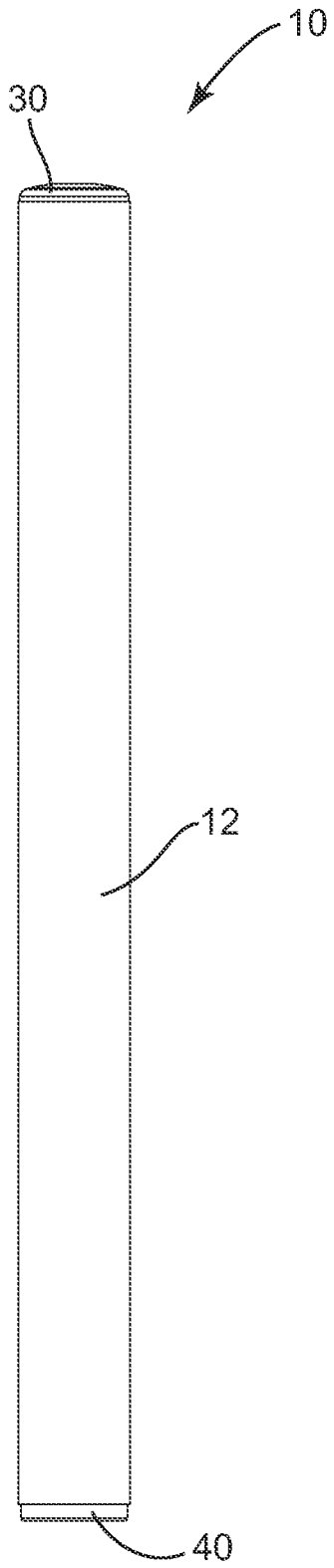
FIG. 7 is a left-side elevational view of the monolithic electronic vaporizer, according to an embodiment.
Figure 8:
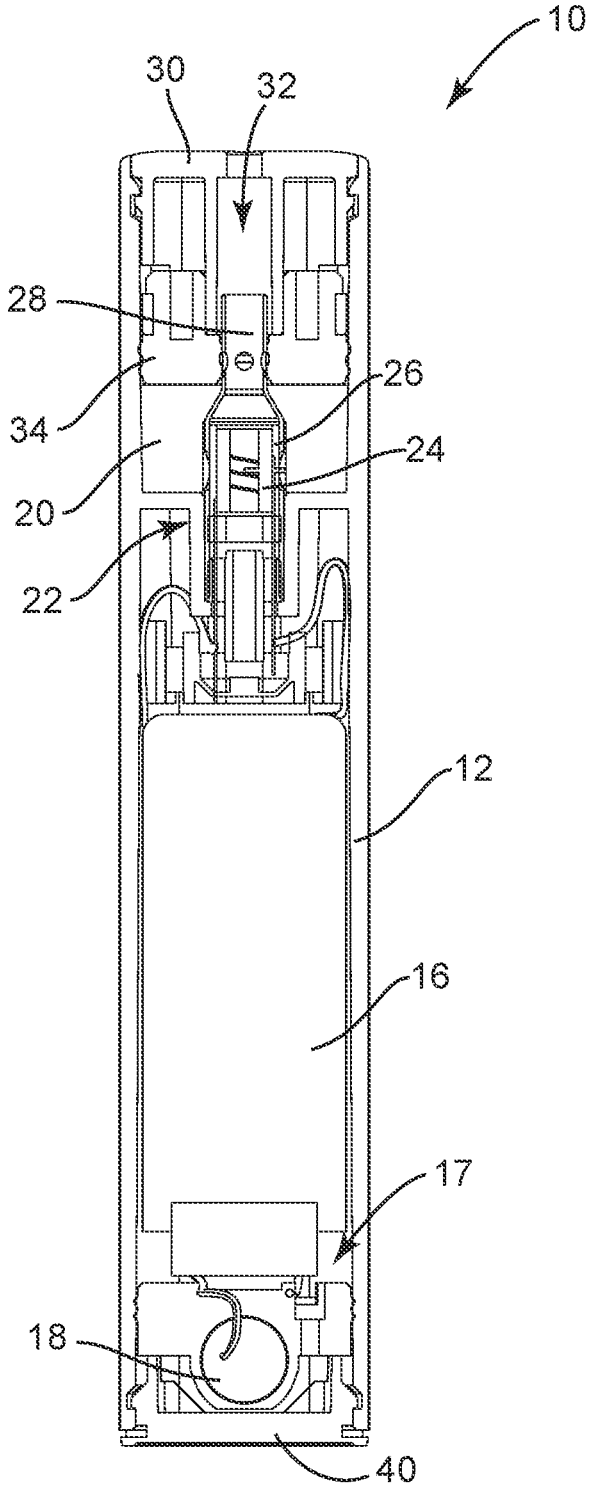
FIG. 8 is a section view of the monolithic electronic vaporizer, according to an embodiment.
Figure 9:
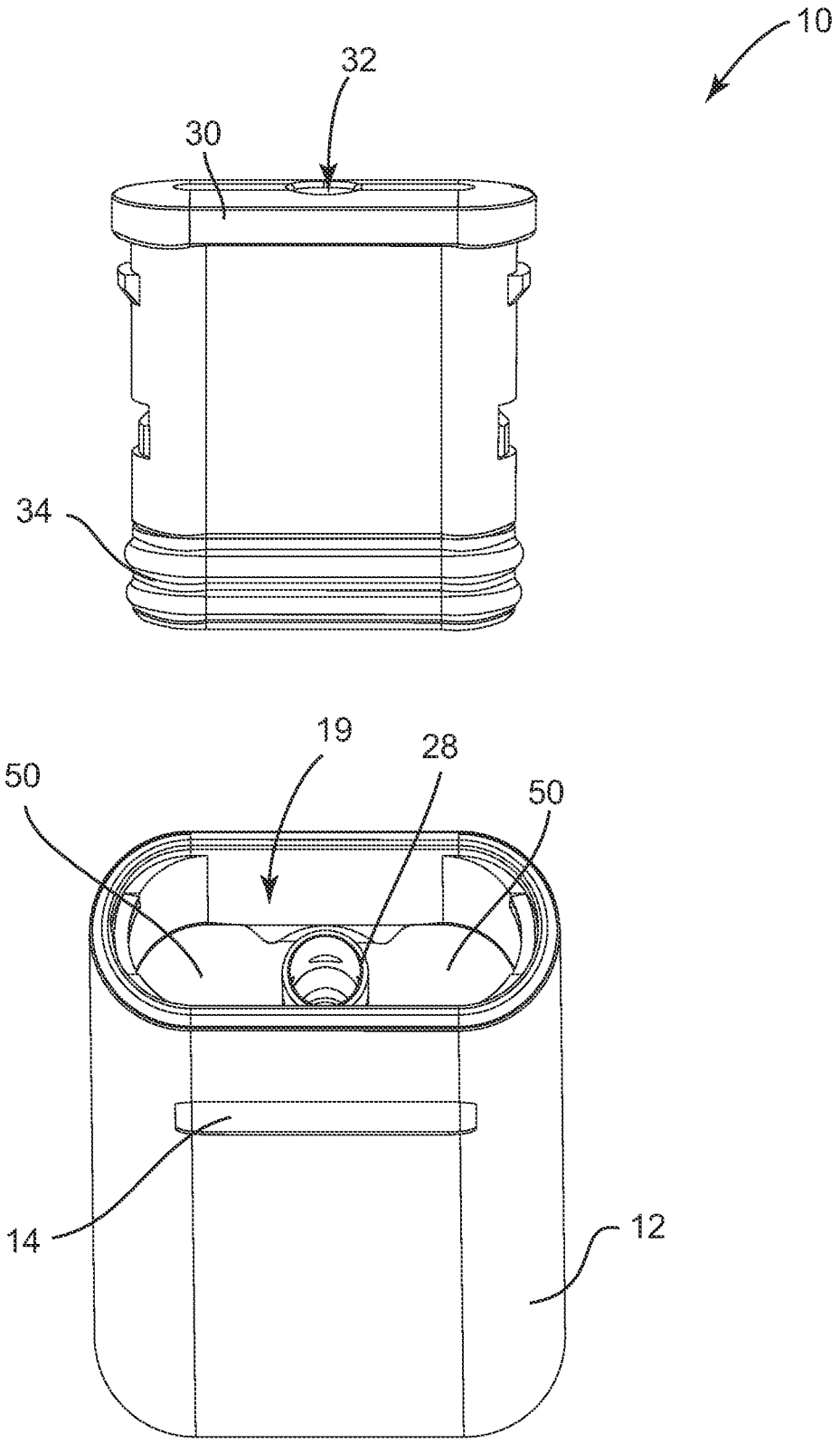
FIG. 9 is a perspective exploded view of the monolithic electronic vaporizer, according to an embodiment.

Referring to FIGS. 1-9, an embodiment of a monolithic electronic vaporizer 10 is depicted. The vaporizer 10 includes a single molded body 12 that functions as the device housing and also as the fluid reservoir (see reservoir 20 in FIG. 8). The body 12 operates to house all of the components necessary for operation of the vaporizer 10. These components include, but are not limited to, a battery 16, a controller 18, a fluid reservoir 20, an atomizer 22 with a heater 24 and a wick 26, and an airway 28, wiring to electronically couple the electrical components together and tie them into the battery 16 and so forth. In some embodiments, the battery 16 is a rechargeable battery. The heater 24 may be a heating element embedded in porous ceramic. The body 12 may be transparent, as shown in FIG. 1B wherein all of the internal components are viewable, or in other embodiments (not shown) the body 12 may be opaque and hide all of the internal components. In other embodiments, as shown in FIGS. 1A and 2-3, the vaporizer 10 may include a wrap 13 that is a flexible substrate that is coupled to (such as, but not limited to, by adhesive) to outer surface of the body 12. The wrap 13 may include an opening or window 14 that exposes the contents of the fluid reservoir 20 allowing a user of the vaporizer 10 to be able to see the volume of vape fluid within the reservoir 20 by viewing it through the window 14. The body 12 further comprises a top recess 19 that is sized and shaped to receive and retain a mouthpiece 30. The body 12 further comprises a bottom recess 17 that allows the assembly of the components of the vaporizer 10, except the atomizer 22 with the heater 24 and the wick 26, the airway 28, and the mouthpiece 30, to be done through an opening in the bottom of the body and into the bottom recess 17 of the body 12. A bottom cap 40 operates to retain these components of the vaporizer 10 within the body 12. The atomizer 22 with the heater 24 and the wick 26, the airway 28, and the mouthpiece 30 are all assembled through the top recess 19.

It will be understood that the single molded body 12 is designed to reduce the number of components needed for final assembly, therefore, reducing the total assembly time of the vaporizer 10. Further, in an effort to make vaporizers that are more sustainable, the single piece molded body 12 can close the gap in recycling costs by making the vaporizer 10 much easier to disassemble. Additionally, the body 12 may be formed of a recyclable material or a material that can be sterilized and reused. This allows the vaporizer 10 to be a product that can reduce the carbon footprint of a disposable electronic vaporizer.

The final assembly of the vaporizer 10 includes filling of the reservoir 20. The body 12 may include a top recess 19 that includes an aperture formed in a bottom of the recess for an airway 28 coupled to the heater 24, to extend into the recess 19. A blunt tipped needle may be inserted in locations 50 between the airway 28 and the reservoir 20, and holding the body 12 upright, vape fluid may be pushed through the needle and into the reservoir 20. Immediately after filling, the mouthpiece 30 may be inserted into the top recess 19 of the body 12 until it is fully seated. The seating of the mouthpiece 30 maybe a tamper resistant press-fit coupling between the mouthpiece 30 and the body 12. An aperture 32 is formed in the mouthpiece 30 that receives a portion of the airway 28 within the aperture 32 and allows air to be drawn through the mouthpiece 30 to initiate the breath actuated operation of the vaporizer 10. Further, the mouthpiece 30 may further include a seal 34 in order to provide an additional seal for the vape fluid to be retained within the reservoir 20. A user should then wait a predetermined amount of time based on the fluid viscosity to allow for saturation of the wick 26.

Additionally, in some embodiments, components of the vaporizer may include a haptic device (not shown). The haptic device may operate to provide haptic feedback to the user during operation of the vaporizer 10. This haptic feedback may be in the form of vibration of the vaporizer as the user draws in air through the vaporizer, vibration as the atomizer 22 operates to create vapor from the fluid, vibrations to alert of low battery, and so forth.

In some embodiments, the controller 18 may provide certain safety features. For example, and without limitation, the safety features may include short-circuit protection and over-usage protection.

Figure 10:
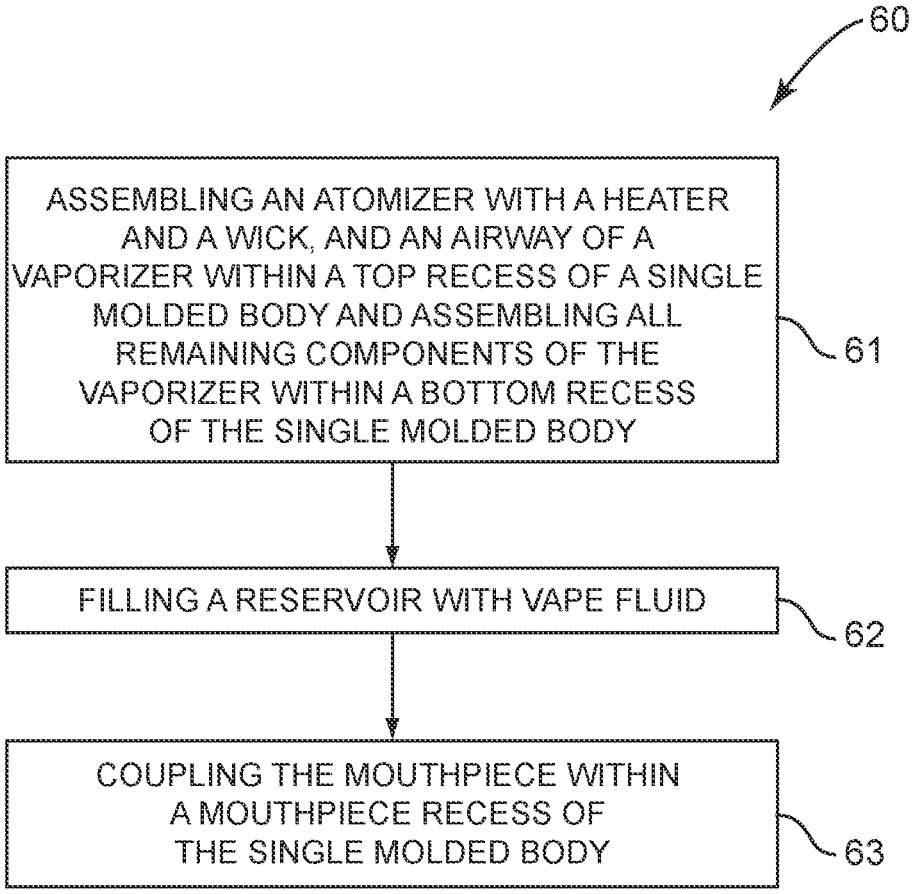
FIG. 10 is a method of assembling a monolithic electronic vaporizer, according to an embodiment.

Referring to the drawings further, FIG. 10 depicts a method 60 of assembling a monolithic electronic vaporizer. The method 60 may include assembling an atomizer with a heater and a wick, and an airway of a vaporizer within a top recess of a single molded body and assembling all remaining components of the vaporizer within a bottom recess of a single molded body (step 61); filling a reservoir with vape fluid, the reservoir formed as part of and within the single molded body (Step 62); and coupling the mouthpiece within the top recess of the single molded body after the reservoir is filled with vape fluid (Step 63).

Step 63 of coupling a mouthpiece within a top recess may further comprise a tamper resistant press-fit. Step 62 of assembling all remaining components of the vaporizer within the bottom recess may further comprise retaining all remaining components of the vaporizer within the single molded body in response to coupling a bottom cap to the bottom recess of the single molded body. Step 63 of coupling the mouthpiece within the top recess of the single molded body may further comprises providing an additional seal for the vape fluid to be retained within the reservoir.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A monolithic electronic vaporizer comprising:

a single molded body comprising:

a fluid reservoir provided within the single molded body;

a top recess provided directly above the fluid reservoir;

a bottom recess provided below the fluid reservoir; and a mouthpiece coupled within the top recess above the fluid reservoir of the single molded body, wherein the mouthpiece is positioned directly above the fluid reservoir of the single molded body.

2. The vaporizer of claim 1, wherein the single molded body comprises a wrap on an outer surface thereof having a transparent window for viewing contents within the fluid reservoir.

3. The vaporizer of claim 1, wherein an atomizer with a heater and a wick, an airway, and the mouthpiece are assembled within the top recess and wherein the vaporizer comprises bottom recess components assembled within the bottom recess of the single molded body.

4. The vaporizer of claim 3, wherein coupling the mouthpiece within the top recess comprises a tamper resistant press-fit.

5. The vaporizer of claim 4, wherein the mouthpiece comprises an aperture extending through the mouthpiece to receive a portion of the airway within the aperture when the mouthpiece is coupled within the top recess and allows air to be drawn through the mouthpiece to initiate breath actuated operation of the vaporizer.

6. The vaporizer of claim 5, wherein mouthpiece comprises a seal on a bottom of the mouthpiece g-O that is coupled within the top recess.

7. The vaporizer of claim 3, further comprising a bottom cap coupled to the bottom recess of the single molded body to retain the bottom recess components of the vaporizer within the single molded body.

8. The vaporizer of claim 1, wherein the vaporizer is disposable.

9. The vaporizer of claim 8, wherein the single molded body is formed of recyclable material or is formed of material that is sterilized and reused.

10. The vaporizer of claim 1, further comprising a controller, wherein the controller provides safety features comprising short-circuit protection, over-usage protection or a combination of both.

11. The vaporizer of claim 1, further comprising a rechargeable battery.

12. The vaporizer of claim 1, further comprising a haptic device for providing haptic feedback during operation of the vaporizer.

13. A method of assembling a monolithic electronic vaporizer, the method comprising:

assembling an atomizer with a heater and a wick, and an airway of the vaporizer within a top recess of a single molded body and assembling bottom recess components of the vaporizer within a bottom recess of the single molded body;

filling a fluid reservoir with vape fluid, the fluid reservoir provided within the single molded body;

positioning the top recess directly above the fluid reservoir of the single molded body;

coupling a mouthpiece within the top recess above the fluid reservoir of the single molded body; and positioning the mouthpiece directly above the fluid reservoir of the single molded body.

14. The method of claim 13, wherein coupling the mouthpiece within the top recess further comprises a tamper resistant press-fit.

15. The method of claim 13, wherein the assembling of the bottom recess components of the vaporizer within the bottom recess further comprises retaining all the bottom recess components of the vaporizer within the single molded body in response to coupling a bottom cap to the bottom recess of the single molded body.

16. The method of claim 13, wherein coupling the mouthpiece within the top recess of the single molded body further comprises providing an additional seal for the vape fluid to be retained within the fluid reservoir.

17. The method of claim 13, wherein the vaporizer is disposable.

18. The method of claim 17, wherein the single molded body is formed of recyclable material or material that is sterilized and reused.

19. The method of claim 13, wherein one of the bottom recess components comprises a rechargeable battery.

20. The method of claim 13, wherein one of the bottom recess components comprises a haptic device.

* * * * *